US006984926B2

(12) United States Patent
Tsuneto et al.

(10) Patent No.: US 6,984,926 B2
(45) Date of Patent: Jan. 10, 2006

(54) COMPACT SELF-BALLASTED FLUORESCENT LAMP RESISTANT TO HEAT DEFORMATION

(75) Inventors: Yuji Tsuneto, Takatsuki (JP); Hiroki Nakagawa, Ibaraki (JP); Akiko Nakanishi, Takatsuki (JP); Kenji Itaya, Takatsuki (JP); Kenji Nakano, Kyoto (JP); Kohhei Iwase, Takatsuki (JP); Hiroki Kitagawa, Kusatsu (JP); Yasushige Tomiyoshi, Takatsuki (JP); Shiro Iida, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 148 days.

(21) Appl. No.: 10/780,100

(22) Filed: Feb. 17, 2004

(65) Prior Publication Data

US 2005/0023947 A1 Feb. 3, 2005

(30) Foreign Application Priority Data

Feb. 28, 2003 (JP) ..... 2003-055004

(51) Int. Cl.
*H01J 1/02* (2006.01)

(52) U.S. Cl. ..... 313/46; 313/45

(58) Field of Classification Search ..... 313/11, 313/17, 19, 25, 28, 37, 39, 40, 46, 318.01, 313/318.1

See application file for complete search history.

(56) References Cited

U.S. PATENT DOCUMENTS 6,597,106 B2 * 7/2003 Toth et al. ..... 313/490

* cited by examiner

*Primary Examiner*—Vip Patel

(57) ABSTRACT

A compact self-ballasted fluorescent lamp has an arc tube in a double-spiral configuration, the arc tube being formed by bending a glass tube around an axis of spiral up to both ends of the glass tube, and a holder that is made of resin and holds this arc tube. Electrodes, each being equipped with a filament coil, are sealed at respective ends of the glass tube. The holder is made up of a holding resin member with a cylindrical shape having a closed bottom and a resin cover in a cone shape, the holder including a circumferential wall and an end wall that is at the edge of the circumferential wall. A heat-dissipating plate is provided inside the holding resin member, at a position corresponding to where the filament coils within the glass tube are.

11 Claims, 9 Drawing Sheets

Prior Art

COMPACT SELF-BALLASTED FLUORESCENT LAMP RESISTANT TO HEAT DEFORMATION

This application is based on application No. 2003-55004 filed in Japan, the contents of which are hereby incorporated by reference.

BACKGROUND OF THE INVENTION (1) Field of the Invention

The present invention relates to a compact self-ballasted fluorescent lamp having an arc tube and a holder, the arc tube being made of a glass tube whose at least one part is bent, ends of the glass tube being respectively provided with an electrode equipped with a filament coil, and the holder being provided with insertion openings through which the ends of the glass tube are inserted and held.

(2) Related Art

In the present energy-saving era, compact self-ballasted fluorescent lamps started to become pervasive as light sources alternative to incandescent lamps. One example of such compact self-ballasted fluorescent lamps is shown in FIG. 1. This compact self-ballasted fluorescent lamp has an arc tube 910 formed by bending a glass tube 911 in a double spiral configuration, and a holder 920 made of resin and holds this arc tube 910. This holder 920 stores therein an electronic ballast for lighting the arc tube 910. At one end of the holder 920, a base 924 that is the same type as for the incandescent lamps is fixed. Each end of the glass tube 911 is provided with an electrode equipped with a filament coil.

The arc tube of this compact self-ballasted fluorescent lamp is formed by bending a glass tube at the substantial middle, and winding the glass tube from the substantial middle up to the both ends, around an axis of spiral (hereinafter, this axis is referred to as "spiral axis") (in FIG. 1, the spiral axis being in the vertical direction and corresponding to the axis of the base). Such an arc tube is advantageous over an arc tube that has ends of the glass tube running parallel to the spiral axis, or over an arc tube formed by connecting three U-shape glass tubes (so to speak, three U-shape arc tube), in that it can be made smaller for the same amount of light emission (refer to Japanese Patent Publication H9-17378).

The mentioned holder 920 that holds the arc tube 910 formed by winding the glass tube up to the ends includes: a holding resin member 925 with a cylindrical shape having a closed bottom and has, at the bottom wall of the cylindrical shape, insertion openings 922 through which ends of the glass tube 911 are inserted; and a resin cover 923 to be fit to the outer surface of the circumference of the holding resin member 925. The ends of the glass tube 911, having been inserted into the insertion openings 922, are attached to the holding resin member 925 of the holder 920, by means of a silicone resin and the like.

Meanwhile, a life test was conducted for a compact self-ballasted fluorescent lamp that uses the arc tube 910, whose glass tube 911 is wound around up to its ends. As a result, at the ending of the lamp life, deformation due to heat was observed at areas of the holding resin member 925 and of the resin cover 923, the areas corresponding to where the filament coils are placed within the glass tube 911.

More specifically, when a life test is conducted by lighting the compact self-ballasted fluorescent lamp with the base 924 directed downward (hereinafter, this way of lighting is referred to as "downward illumination"), Sa area of an end wall 921 of the holding resin member 925 is deformed due to heat, as shown in FIG. 1. This Sa area is the area that positions directly over a filament coil of the glass tube 911.

If a life test is conducted by lighting the compact self-ballasted fluorescent lamp with the base 924 directed in the lateral direction (hereinafter, this way of lighting is referred to as "lateral illumination"), Sb area of the circumferential wall of the resin cover 923 is deformed, as shown in FIG. 1. Deformation was most pronounced when the compact self-ballasted fluorescent lamp is laid so that the filament coil provided in one of the ends of the glass tube 911 positions at the top.

Note that FIG. 1 shows the compact self-ballasted fluorescent lamp after ending of the life test, and is for both of the life test in the downward illumination, and the life test in the lateral illumination, for convenience purpose.

SUMMARY OF THE INVENTION

In light of the aforementioned problems, the object of the present invention is to provide a compact self-ballasted fluorescent lamp that restrains deformation of the holder, even when one or both of the electrodes generate extraordinary heat, at the end of the life.

In order to achieve this object, the compact self-ballasted fluorescent lamp of the present invention includes: an arc tube made of a glass tube that has a turning part, and of electrodes sealed in ends of the glass tube, the electrodes being each equipped with a respective one of filament coils; a holder that is provided with insertion openings and holds the arc tube so that the ends of the glass tube are inserted through the respective insertion openings and that the filament coils are positioned inside the holder; and heat-dissipating members provided for two places that are respectively between an outer surface of the glass tube and an inner surface of the holder, each of the places corresponding to a different one of the filament coils.

Here, each of the "two places" corresponds to a different one of the filament coils, and is between an outer surface of the glass tube and an inner surface of the holder that faces the outer surface of the glass tube.

With this construction, heat generated from the filament coils will be prevented from being directly transmitted to the holder in the vicinity of the filament coils. Moreover, the heat from the filament coils, after being transmitted to the heat-dissipating member through the glass tube surrounding the filament coils, will be dispersed in the heat-dissipating member. This prevents heat transmission from concentrating on one spot of the inner surface of the holder.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENTS

The following describes an embodiment in which the present invention is applied to a compact self-ballasted fluorescent lamp, with reference to FIGS. 2–7.

1. The Structure (a) Overall Structure

Figure 2:
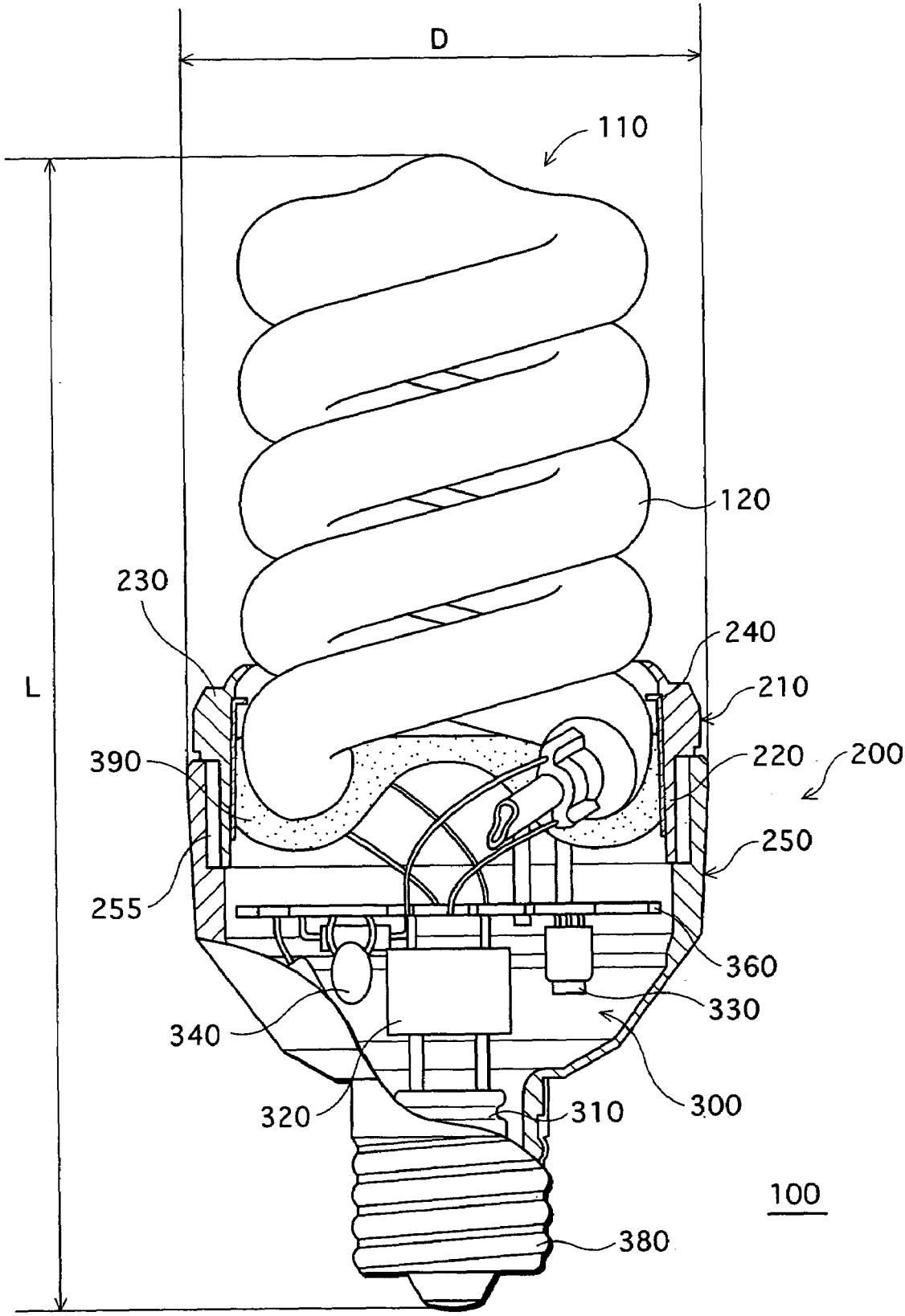
FIG. 2 shows a front partly-cut view of a compact self-ballasted fluorescent lamp of the present embodiment.

As shown in FIG. 2, a compact self-ballasted fluorescent lamp 100 includes: an arc tube 110 formed by bending a glass tube 100 in a double-spiral configuration; and a holder 200 that is made of resin and is for holding the arc tube 110. Note that this compact self-ballasted fluorescent lamp 100 is not provided with a globe for covering the arc tube 110 (i.e. so-called globeless type).

As shown in FIG. 2, the holder 200 has: a holding resin member 210 with a cylindrical shape having a closed bottom, and includes a circumferential wall 220 and an end wall 230 that is formed at the edge of the circumferential wall 220; and a resin cover 250 shaped like a cone. An inner surface of the resin cover 250 at the side of its opening (top side in FIG. 2) is fit to the outer surface of the circumferential wall 220 of the holding resin member 210, thereby creating a space to store an electronic ballast 300.

The electronic ballast 300 is made up of a plurality of electric parts that include an FET power transistor 330, capacitors 310 and 340, and a choke coil 320, and adopts a series inverter method. A substrate 360, to which these electric parts are to be mounted, is attached to the holding resin member 210. In addition, a lower part of the resin cover 250 (opposite to where the holding resin member 210 is to be fit) is provided with a base 380 that is the same type as for the incandescent lamps.

(b) Arc Tube

Figure 3:
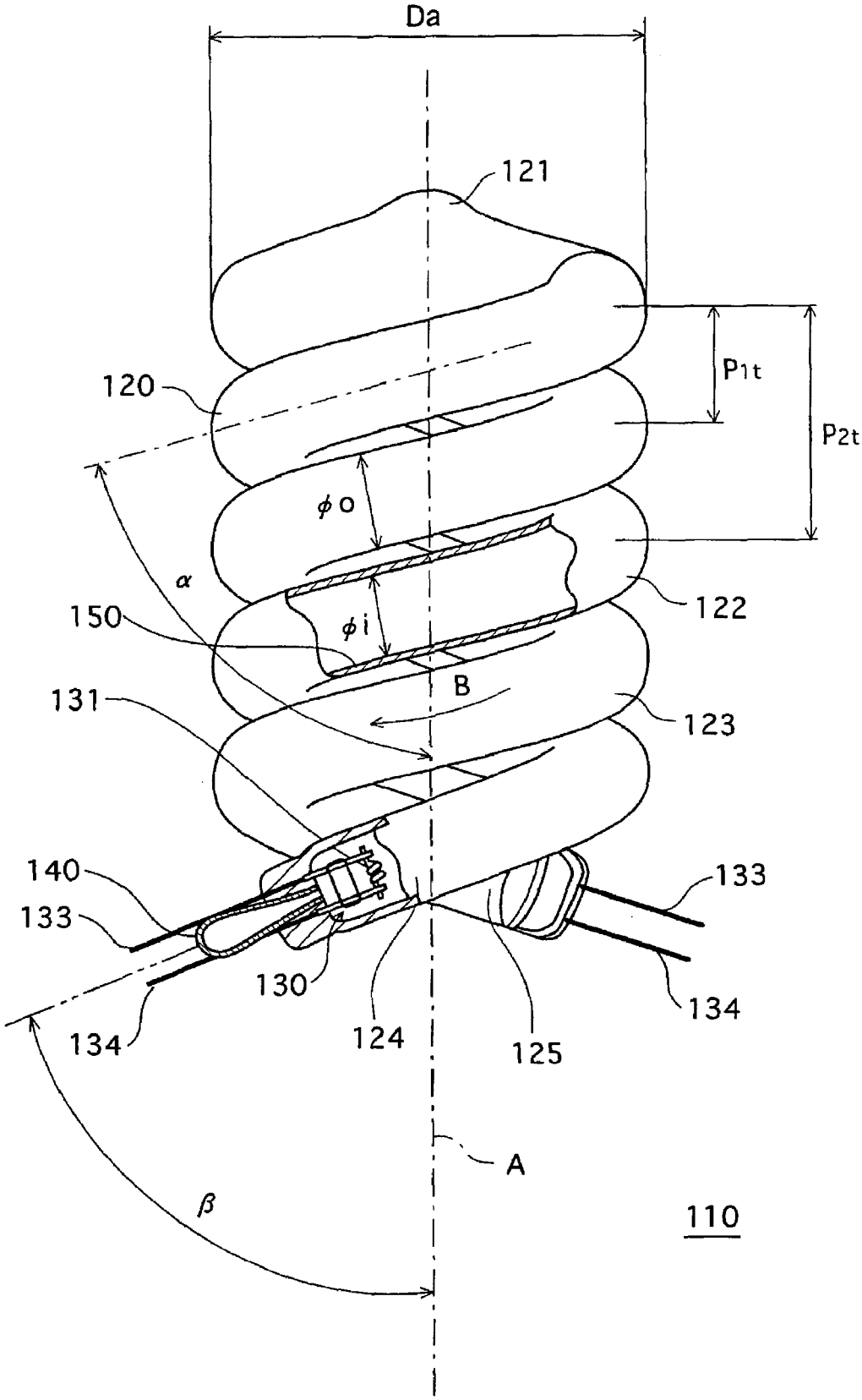
FIG. 3 shows a front partly-cut view of an arc tube of the present embodiment.

As shown in FIG. 3, the arc tube 110 is in a double-spiral configuration and includes: a turning part 121 at which the glass tube 120 is bent in the substantial middle; and two spiral parts 122 and 123, which are formed by winding the both sides from the turning part 121 to the both ends of the glass tube 120 around a spiral axis A and in the direction B. Note that the glass tube 120 is, for example, made of a soft glass (e.g. strontium-barium silicate glass).

For the most part, the spiral parts 122 and 123, of the glass tube 120, are wound around the spiral axis A, with an inclination angle of $\alpha$ with respect to the spiral axis A. However, the inclination angle changes from $\alpha$ to $\beta$ that is smaller than $\alpha$, in the vicinity of the ends of the glass tube 120 (More specifically, in a range of 90 degrees from an end of the glass tube 120 around the spiral axis A, in the direction opposite to the direction B). Hereinafter, this part of the glass tube 120 is referred to as "end-vicinity part".

At each end of the glass tube 120, an electrode 130 is sealed. The electrode 130 is made up of a filament coil 131 made of tungsten, and a pair of lead wires 133 and 134 that support the filament coil 131 by way of a so-called beads glass mounting method. Note that, the ends of the glass tube 120 to which electrodes 130 are to be sealed correspond to the ends of one discharge space formed inside the arc tube 110.

Each filament coil 131 is filled with an electron emissive material whose main substance is such as BaO—CaO—SrO.

In addition, to one end of the glass tube 120 (in this example, the end-vicinity parts having the reference sign of 124), an exhaust tube 140 is fixed at the time of sealing the electrode 130, the exhaust tube 140 being used for producing a vacuum within the glass tube 120, and sealing such as mercury and a buffer gas that are detailed later. Note that the tip of the exhaust tube 140 is sealed such as in a cut-off method, after completing the evacuation of the glass tube 120 and the sealing of such as mercury and a buffer gas.

In the glass tube 120, argon as a buffer gas is sealed at 400 Pa, besides about 5 mg of mercury. Note that a buffer gas may alternatively be a mixture gas of argon and neon.

In addition, a phosphor 150 is applied on the inner surface of the glass tube 120. This phosphor 150 is produced by mixing three kinds of rare-earth phosphors respectively emitting red ($Y_2O_3$:Eu), green ($LaPO_4$:Ce, Tb), and blue ($BaMg_2Al_{16}O_{27}$:Eu, Mn).

(c) Holder

The holder 200 is made up of the holding resin member 210 and the resin cover 250 (refer to FIG. 2), and for which a PET (polyethylene terephthalate; having softening point of about 260° C.) is used for example. This resin has excellent heat-resistant characteristic, as well as high ultraviolet-resistant characteristic. Note that the holding resin member 210 is the holder of the present invention.

Figure 4:
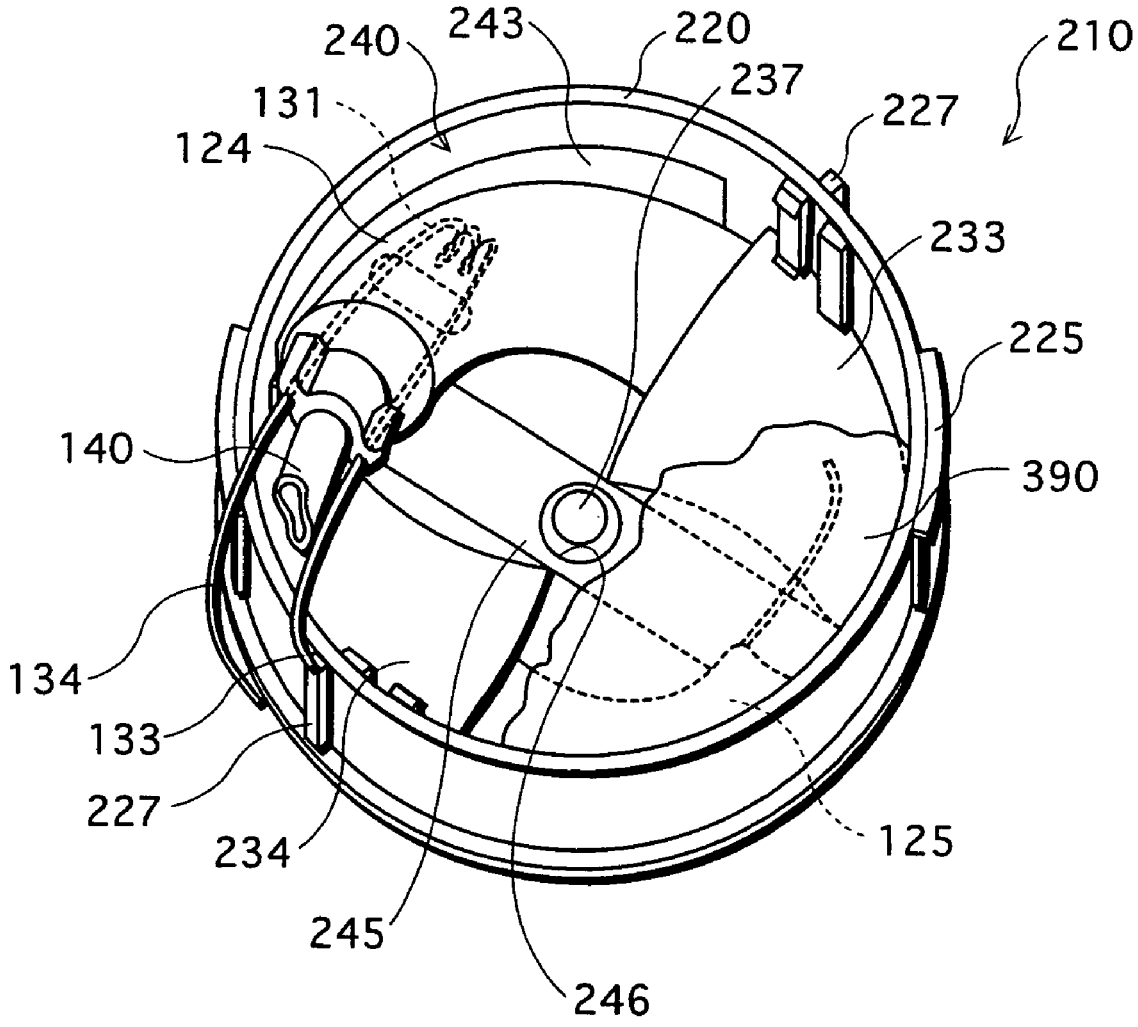
FIG. 4 is a perspective view showing how the arc tube is held by the holding resin member of the present embodiment, seen from the rear side of the holding member (illustrating only part of the arc tube inserted within the holding resin member)
Figure 5A:
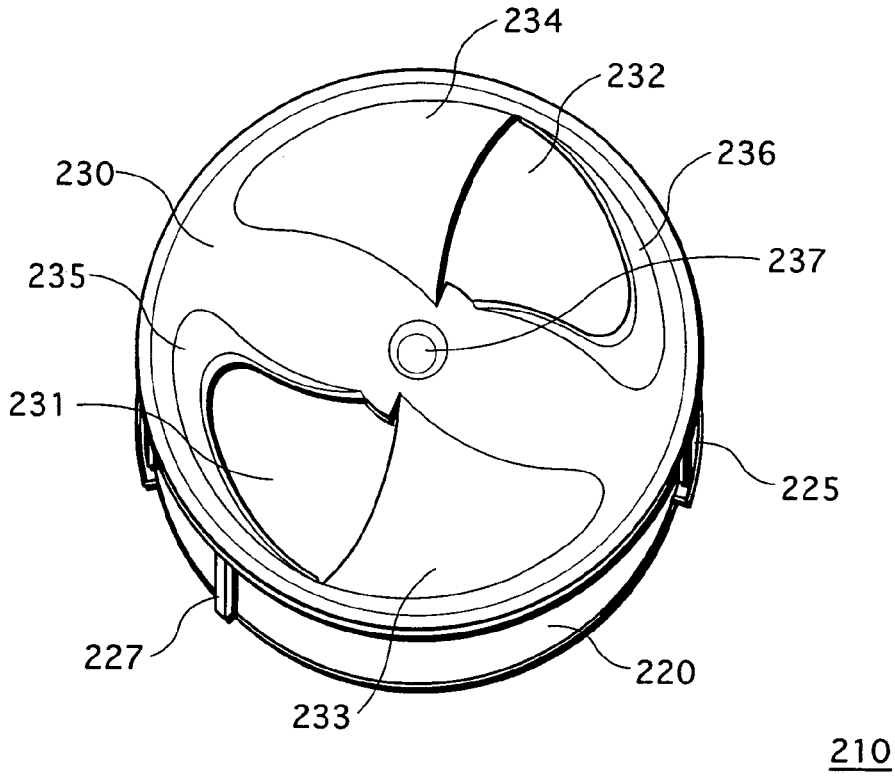
FIG. 5A shows a perspective view of the holding resin member of the present embodiment, which is seen from the front side thereof.
Figure 5B:
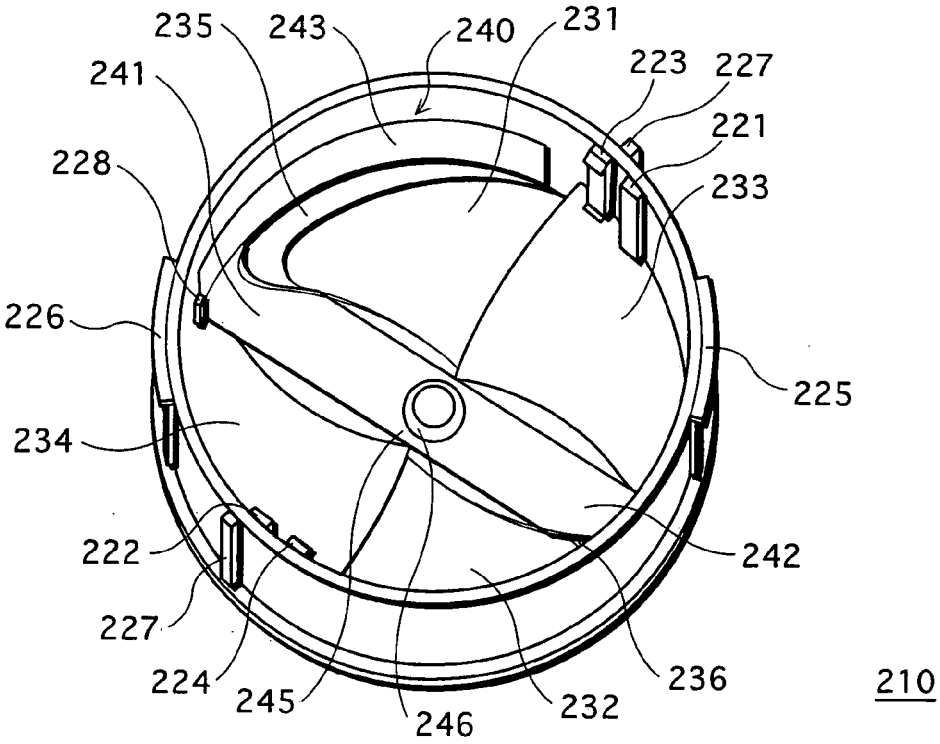
FIG. 5B shows a perspective view of the holding resin member, seen from the rear side thereof.

The holding resin member 210 is, as shown in FIGS. 5A and 5B, made up of an end wall 230 and a circumferential wall 220. First, the end wall 230 is described. This end wall 230 has a pair of insertion openings 231 and 232, through which the ends of the glass tube 120 are inserted inside the holding resin member 210 (inside the holder 200). As shown in FIGS. 2 and 4, the arc tube 110 is held by attaching the end-vicinity parts 124 and 125 having been inserted through the insertion openings 231 and 232, to the inner surface of the holding resin member 210 via a silicone 390. Note that, in FIG. 4, so as to reveal the area near the end-vicinity part 124 of the glass tube 120, a silicone resin being attached thereto is not illustrated. In addition, the part of the arc tube 110 that appears outside the holding resin member 210 is not illustrated.

Here, when the glass tube 120 is inserted into the holding resin member 210, a side into which the end of the glass tube 120 is to be inserted is referred to as "lower side" and the opposite side thereto is referred to as "upper side".

As shown in FIG. 5A, in the upper side of the insertion openings 231 and 232, guides 233 and 234 are formed to facilitate fixing of the arc tube 110 to the holding resin member 210. Because of this arrangement, when the arc tube 110 is rotated into the direction B, so that the rotation axis coincides with its own spiral axis A, while the end-vicinity parts 124 and 125 of the glass tube 120 are made abut against the guides 233 and 234, then the ends of the glass tube 120 will be naturally guided in the insertion openings 231 and 232. (Alternatively, for the purpose of fixing the arc tube 110, the holding resin member 210 may be rotated, with the rotation axis corresponding to its axis, into the opposite direction to the direction B)

The guides 233 and 234 are formed to coincide with the form of a circumferential portion of the end-vicinity parts 124 and 125 of the glass tube 120, the circumferential portion positioning at the side of the holding resin member 120. Which is to say, suppose rotating the arc tube 110 so that the rotation axis coincides with its spiral axis A, while having the spiral axis A to substantially coincide with the axis of the holding resin member 210, then the ends of the glass tube 120 will move along a predetermined orbit. The guides 233 and 234 have forms that coincide with this orbit that the ends of the glass tube 120 are in, and so become deeper as the insertion openings 231 and 232 are nearer.

On the other hand, in the lower side of the insertion openings 231 and 232, the covers 235 and 236 are formed in the form of an arc that coincides with the form of the end-vicinity parts 124 and 125 (form of circle) of the arc tube 110, so as to be able to cover these end-vicinity parts 124 and 125.

Next, the circumferential wall 220 of the holding resin member 210 is described. The circumferential wall 220 is, as shown in FIG. 2 and FIG. 5B, provided with: a pair of supporting members 221 and 222 for supporting the substrate 360 to which the electronic ballast 300 is mounted, from the side of the end wall 230; and a pair of substrate-latching members 223 and 224 to be engaged with the surface of the substrate 360 where the base 380 is (the substrate 360 is not shown in FIGS. 5A and 5B).

Next, the resin cover 250 is described. The resin cover 250 is in a cone shape as shown in FIG. 2, and one end thereof that opens wider (hereinafter simply referred to as "end with larger diameter") than the other end is fit to the outer surface of the circumferential wall 220 of the holding resin member 210. To the other end of the resin cover 250 that opens narrower (hereinafter simply "end with smaller diameter"), the base 380 is attached.

Fixing of the resin cover 250 to the holding resin member 210 is performed by coupling the cover-coupling members 225 and 226, formed at the circumferential wall 220 of the holding resin member 210, with the protrusion (unshown in the drawings) formed on the inner surface of the resin cover 250.

Even after the resin cover 250 has been fixed to the holding resin member 210, there is a clearance between the inner surface nearer the end with larger diameter of the resin cover 250, and the outer surface of the circumferential wall 220 of the holding resin member 210. A heat-insulation layer of this invention is formed in this clearance.

Note that so as to substantially coincide the axis of the resin cover 250 with the axis of the holding resin member 210, a plurality of protrusions 227 (three or more) for locating purpose are formed on the outer surface of the circumferential wall 220, with interval in the circumferential direction (refer to FIGS. 4 and 5).

Inside the holder 200, which is comprised of the holding resin member 210 and the resin cover 250 described above, a metal plate 240 is provided at an area in which the filament coils 131 are included, as shown in FIGS. 2 and 4. Note that each of FIGS. 3, and 4 illustrates only one filament coil for explanation purpose. However, the number of "filament coils 131" is two in the embodiment. This metal plate 240, as shown in FIG. 5B, is comprised of a rear-surface parts 241 and 242 to be provided at the rear surface of the end wall 230, and side-surface parts 243 and 244 to be provided at the inner surface of the circumferential wall 220, so as to coincide with each location of the pair of electrodes 130.

The metal plate 240 is provided to make allowance for at least variations in position of the filament coils 131, as well as to assuredly transmit the heat generated by the filament coils 131 from the glass tube 120 to the metal plate 240. The amount of the ends of the glass tube 120 inserted inside the holding resin member 210 is determined by the length of the arc tube 110 that should appear external to the holding resin member 210 that holds it (i.e. the distance from the ends of the turning part 121 of the arc tube 110 up to the surface of the end wall 230 of the holding resin member 210), and not determined by the position of the filament coils 131. Accordingly, it is quite possible to cause variations in position of the filament coils 131 within the glass tube 120.

The metal plate 240 has a structure in which parts thereof that respectively correspond to the ends of the glass tube 120 (each of the "parts" being a heat-dissipating member of the present invention) are connected together by a connecting part 245. The connecting part 245 is provided with a locating hole 246 at the substantial center thereof, the locating hole 246 being to which a locating protrusion 237 is to be fit. The locating protrusion 237 is provided at the substantial center of the end wall 230 of the holding resin member 210. This arrangement enables to perform fixing of the metal plate 240 to the holding resin member 210, as well as locating thereof, easily and efficiently.

2. Concrete Structure

The compact self-ballasted florescent lamp 100, in the present embodiment, is of 12 w type that corresponds to the incandescent lamp of 60 W type, and E17 is used for its base 380.

The following explains the sizes of the arc tube 110, with use of FIG. 3. The arc tube 110 has 4.5 turns, which is a total number for both of the spiral parts 122 and 123, so as to be in accordance with the luminous flux of when the incandescent lamp emits light.

The outer diameter Da of the arc tube 110 (i.e. outermost diameter of the spiral parts of the glass tube) is 36 mm. The tube-inner diameter $\phi i$ of the glass tube 120 is 7.4 mm, and the tube-outer diameter $\phi o$ of the glass tube 120 is 9 mm. Preferably, the outer diameter Da of the arc tube 110 should be in the range of 30 mm to 40 mm, inclusive, so as to have the equal size as the incandescent lamp.

In addition, the tube-outer diameter $\phi o$ of the glass tube 120 should preferably be smaller than 10 mm. This is because if the tube-outer diameter $\phi o$ becomes 10 mm or above, the flexural rigidity of the glass tube 120 will be large. This makes it difficult to form outer diameter Da of the arc tube 110 to be small such as about 36 mm.

Furthermore, between the part of the glass tube 120 from the turning part 121 and before the end-vicinity parts 124 and 125, a pitch P2*t* is 20 mm, the pitch P2*t* being either between two adjacent spiral parts 122 or between two adjacent spiral parts 123, in a direction parallel to the spiral axis A (i.e. vertical direction in FIG. 3). In addition, a pitch P1*t* is 10 mm, the pitch P1*t* being between any two adjacent spiral parts 122 and 123, in the direction parallel to the spiral axis A. This means that a minimum clearance formed between the glass tubes 120 that are adjacent to each other in a direction parallel to the spiral axis A is about 1 mm. This clearance is preferably 3 mm or below. This is because, if this clearance becomes larger than 3 mm, the length of the arc tube 110 will become large, and in addition the adjacent portions of the glass tube 120 will be far from each other, leading to inconsistencies in luminance.

Note that the distance between the filament coils 131 within the arc tube 110 is 400 mm, and the length of the arc tube 110 (i.e. distance from the tip of the glass tube 120 which is at the turning part 121, to the sealing part at the ends of the glass tube 120, in the direction parallel to the spiral axis A) is 60.0 mm.

The sizes of the holding resin member 210 are as follows. The inner diameter of the circumferential wall 220 is 38 mm, the outer diameter of the circumferential wall 220 is 42.7 mm, and the height of the circumferential wall 220 is about 15 mm. On the other hand, the inner diameter of the resin cover 250 that is to be fit to the outer surface of the circumferential wall 220 of the holding resin member 210 is 44.4 mm. Accordingly, the heat-insulation layer 255 formed between the holding resin member 210 and the resin cover 250 will be 0.85 mm.

Figure 6:
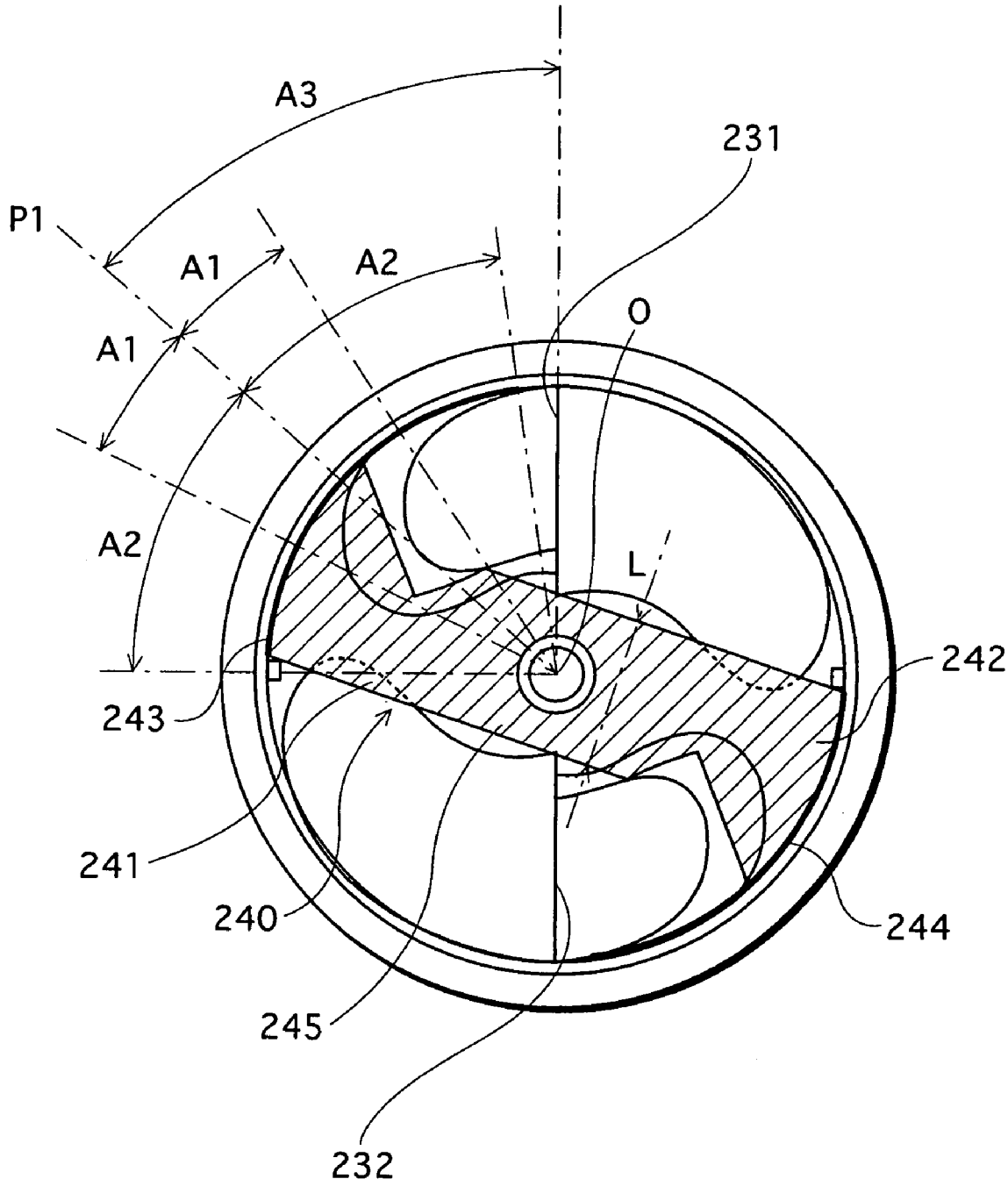
FIG. 6 illustrates the holding resin member so that the inner surface of its end wall will be shown, FIG. 6 being for showing the range of the metal plate provided within the holding resin member.

On the other hand, as FIG. 6 shows, the metal plate 240 is provided so that the centers of the side-surface parts 243 and 244, in circumferential direction, coincide with the position P1 at which the filament coils 131 are to be placed.

The circumferential size for the side-surface parts 243 and 244 corresponds to the range of ±40 degrees from the position P1 around the axis O of the holding resin member 210 (the range shown by the reference number A2 in the drawing). The aforementioned structure applies to both sides of the insertion opening 231 and 232. In addition, the height of the side-surface parts 243 and 244 is 9 mm (i.e. the height being in the direction parallel to the spiral axis A).

The position P1 at which one filament coil 131 is to be placed is located at 50 degrees from the insertion opening 231 (or from the insertion opening 232) around the axis O of the holding resin member 210, in the direction that the ends of the glass tube 120 are inserted (reference number A3 in the drawing).

This position P1 is an average taken in the actual tests for fixing the arc tube 110 to the holding resin member 210. In the tests, filament coils 131 within the glass tube 120 positioned in the range between ±15 degrees (reference number Al in the drawing) from the position P1 around the axis O of the holding resin member 210.

On the other hand, the connecting part 245 and the rear-surface parts 241 and 242, taken altogether, constitute a band-like structure (represented in hatch pattern in FIG. 6), whose width L is about 9 mm. The shapes of the rear-surface parts 241 and 242 coincide with the shape of the inner surface of the end wall 230 (including the concave part of the covers 235 and 236). As a matter of course, the parts that correspond to the insertion openings 231 and 232 are cut away.

The compact self-ballasted fluorescent lamp 100 has the maximum lamp diameter D of 40 mm and the length L of 97 mm, which is smaller than incandescent lamps having maximum lamp diameter of 60 mm and length of 100 mm. The lamp characteristics of this compact self-ballasted fluorescent lamp 100 are that the average luminous flux of 810 lm at the lamp input of 12 W, and the average lamp efficiency of 67.51 m/W.

3. Fixing of Arc Tube

The following explains, in the compact self-ballasted fluorescent lamp 100 having the aforementioned structure, how the metal plate 240 is incorporated into the holding resin member 210, and how the arc tube 110 is fixed to the holding resin member 210 into which the metal plate 240 has been incorporated. Note here that the production method of the arc tube 110, such operations as fixing of the electronic ballast 300 and the base 380 after the arc tube 110 has been fixed to the holding resin member 210, and so on, are the same as those of the conventional technology, therefore are not described here.

(a) Incorporation of Metal Plate to Holding Resin Member

Figure 7A:
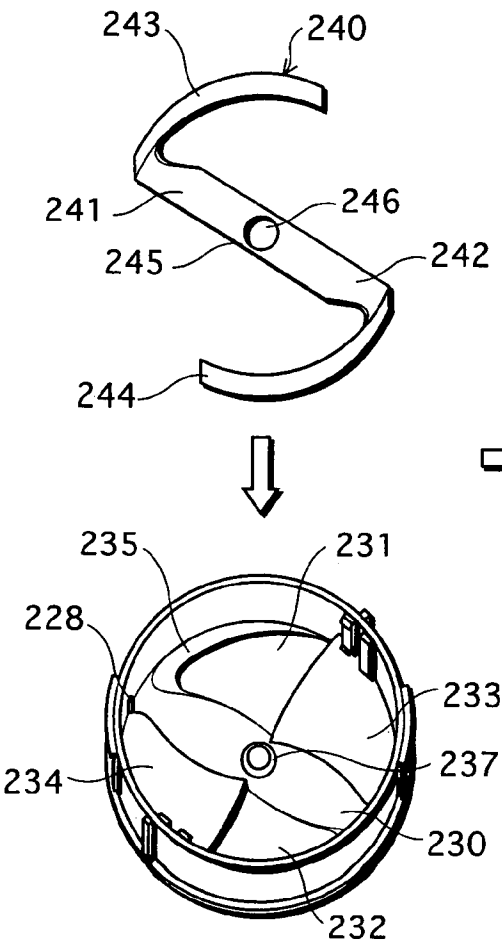
FIGS. 7A, 7B, and 7C are schematic diagrams for explaining how to place the metal plate in the holding resin member, and how to fix the arc tube to the holding resin member.

First, the metal plate 240 is prepared. The metal plate 240 is produced for example by press-forming an aluminum plate. Then, as FIG. 7 shows, thus produced metal plate 240 is, for placement, inserted from the opening of the holding resin member 210 to the inside, while the rear-surface parts 241 and 242 of the metal plate 240 are kept abut against the rear surface of the end wall 230.

Figure 7B:
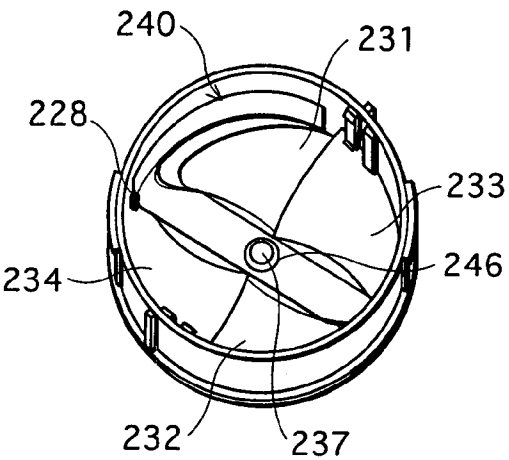
Figure 7C:
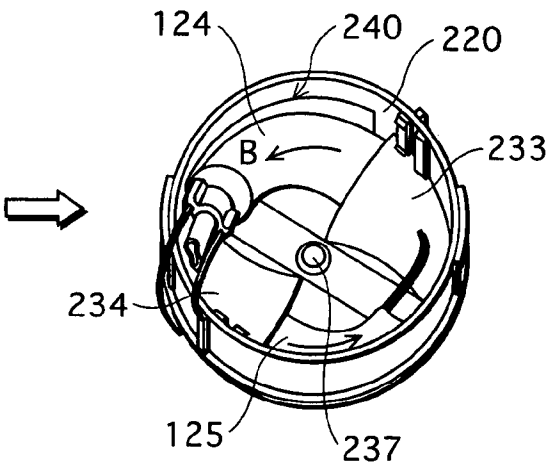

In this operation, it should be made sure that the locating hole 246 at the center of the metal plate 240 is engaged in the locating protrusion 237 at the end wall 230 of the holding resin member 210, as well as that edges of the respective side-surface parts 243 and 244 are abutted against the restricting protrusions 228 of the holding resin member 210, the edges being situated in the direction into which the arc tube 110 is inserted. The metal plate 240 is thereby placed at a predetermined position within the holding resin member 210 (FIG. 7B)

(b) Fixing of Arc Tube to Holding Resin Member

The following explains fixing of the arc tube 110 to the holding resin member 210 in which the aforementioned metal plate 240 has been incorporated. Note that the part of the arc tube 110 that appears outside the holding resin member 210 is not described in FIG. 7C.

First, the ends of the glass tube 120 are inserted through the insertion openings 231 and 232, while keeping the holding resin member 210 upright position with its opening on top.

More specifically, guides 233 and 234 are formed in the upper side of the respective insertion openings 231 and 232 of the holding resin member 210, so as to guide the ends of the glass tube 120. Therefore, if the end-vicinity parts 124 and 125 are made abut against the guides 233 and 234, and the glass tube 120 is rotated so that the rotation axis coincides with the spiral axis A, the ends of the glass tube 120 can enter into the holding resin member 210 through the insertion openings 231 and 232. Needless to say, it is alternatively possible to rotate the holding resin member 210 around itself, with the glass tube 120 in fixed state.

Next, the arc tube 110 is rotated around the spiral axis A to adjust the position thereof, so that the portion of the arc tube exposed outside of the holding resin member 210 has a predetermined length. After the location of the arc tube 110 has been determined, a silicone resin 390 is provided to cover an area corresponding to the end-vicinity parts 124 and 125, including the ends of the glass tube 120. Then, the provided silicone resin 390 is hardened. The fixing of the ends of the glass tube 120 as well as the end-vicinity parts 124 and 125, to the holding resin member 210 are thereby complete.

Note here that, when the end-vicinity parts 124 and 125 of the glass tube 120 is fixed by means of the silicone resin 390, it is made sure that the metal plate 240 be also fixed to the holding resin member 210. By doing so, fixing for both of the metal plate 240 and the glass tube 120 is enabled by only one operation of providing the silicone resin 390 for the end-vicinity parts 124 and 125 of the glass tube 120.

Note that, in the above description, the silicone resin 390 is provided to cover the end-vicinity parts 124 and 125 including the ends of the glass tube 120, and the metal plate 240. However, it is not always necessary to entirely cover the end-vicinity parts 124 and 125 including the ends of the glass tube 120, and the metal plate 240, as long as the end-vicinity parts 124 and 125 of the glass tube 120, and the metal plate 240 are fixed inside the holding resin member 210.

Meanwhile, restricting protrusions 228 are provided inside the holding resin member 210, so as to be abutted against the respective ends of the side-surface parts 243 and 244, the ends positioning in the insertion direction of the glass tube 120. When inserting of the glass tube 120 from the insertion openings 231 and 232 to inside of the holding resin member 210, these restricting protrusions 228 prevent the metal plate 240 from moving in the insertion direction of the glass tube 120. Therefore, even if not being attached to the holding resin member 210, the metal plate 240 will not be misaligned in the insertion direction.

It should be noted here that in the present embodiment, the metal plate 240 is not attached to the inside of the holding resin member 210. Alternatively, however, before the metal plate 240 is fixed to the holding resin member 210, it is also possible to apply adhesives to the inner surface of the end wall 230 of the holding resin member 210, or to the rear-surface parts 241 and 242 of the metal plate 240. The above arrangement enables the metal plate 240 and the holding resin member 210 attached to each other, after the fixing.

4. Life Test

Next, a life test has been performed for the compact self-ballasted fluorescent lamp 100 structured as above. The lighting conditions are the same as those explained in the "problem to be solved by the invention" section, and the test has been performed by lighting the compact self-ballasted fluorescent lamp 100 in downward illumination and in lateral illumination.

As a result of the life test for the compact self-ballasted fluorescent lamp 100, the test life thereof was 10,000 hours. Note here that the test life is a smaller one of the total lighting hours until the lamp ceases to illuminate, and the total lighting hours until the total luminous flux lowers down to 60% of the initial luminous flux (i.e. luminous flux of when 100 hours has passed after the starting of lighting). Hereinafter, the compact self-ballasted fluorescent lamp 100 of the present invention is also referred to as "invention product", and a conventional type of compact self-ballasted fluorescent lamps without the metal plate and so on, is called "conventional product".

In the life test directed to the invention product, no local deformation was observed either in the holding resin member 210 or in the resin cover 250 after finishing of the life, regardless of the posture of the lamp in lighting (i.e. whether in downward illumination or in lateral illumination). Note that at the time of finishing of the life, the protection circuit of the electronic ballast 300 worked to stop the discharge (specifically, causing breakdown of the FET power transistor 330 for lighting the arc tube 110).

There are two possible reasons why the holder 200 of the invention product did not have any local deformation. First, the metal plate 240 provided inside the holding resin member 210 is considered to have worked to prevent the heat generated from the filament coils 131 from being directly transmitted to the holding resin member 210.

Secondly, the heat generated from the filament coils 131 is transmitted to the silicone resin 390 provided for fixing the glass tube 120, and then from this silicone resin 390 to the metal plate 240. During this process, the heat transmitted to the metal plate 240 is considered to spread over the entire metal plate 240, and then dissipated, as well as being dispersed inside the holding resin member 210. Here, since the amount of heat transmitted to the holding resin member 210 is small, the amount of heat transmitted to the resin cover 250 from the holding resin member 210 is accordingly small, too.

Figure 1:
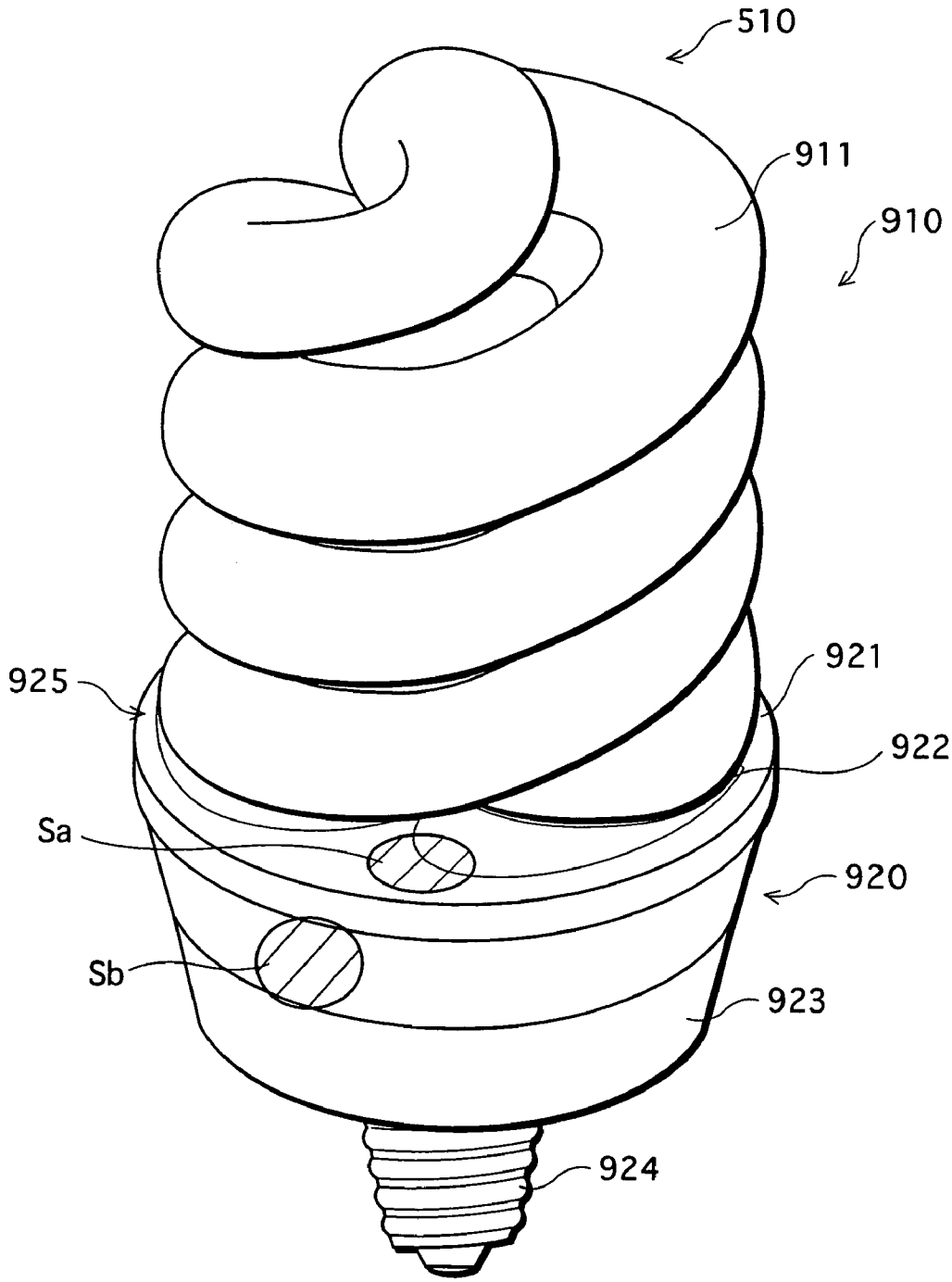
FIG. 1 shows a perspective view of a conventional compact self-ballasted fluorescent lamp, for showing parts of the holder deformed due to heat after a life test has been conducted for this conventional compact self-ballasted fluorescent lamp.

As a result, in the life test where the conventional product was lit in downward illumination with the filament coils positioning on top, the filament coils generated extraordinary heat, thereby deforming not only the inner surface of the holding resin member 925, but also the resin cover 923 (refer to FIG. 1). However, in the invention product, even when it resulted in the same condition, the resin cover 250 was saved from deformation.

Furthermore, since the invention product has the heat-insulation layer 255 between the resin cover 250 and the holding resin member 210, the heat hot enough to deform the resin cover 250 will never be transmitted to the resin cover 250.

Still further, the area in which the metal plate 240 is provided corresponds to the range of ±40 degrees, around the axis O of the holding resin member 210, from the position where each filament coil 131 is expected to be provided. This range of area takes into consideration the positional variation of the filament coils 131 that is incident to assembly process of the arc tube 110, and so the heat from the filament coils 131 will be prevented from being directly transmitted to the holding resin member 210.

<Modification Example>

So far, the present invention has been described by way of the embodiment. However, needless to say, the present invention should not be limited to the concrete example stated above as the embodiment, and may include the following modification examples.

1. Compact Self-Ballasted Fluorescent Lamp

Figure 8:
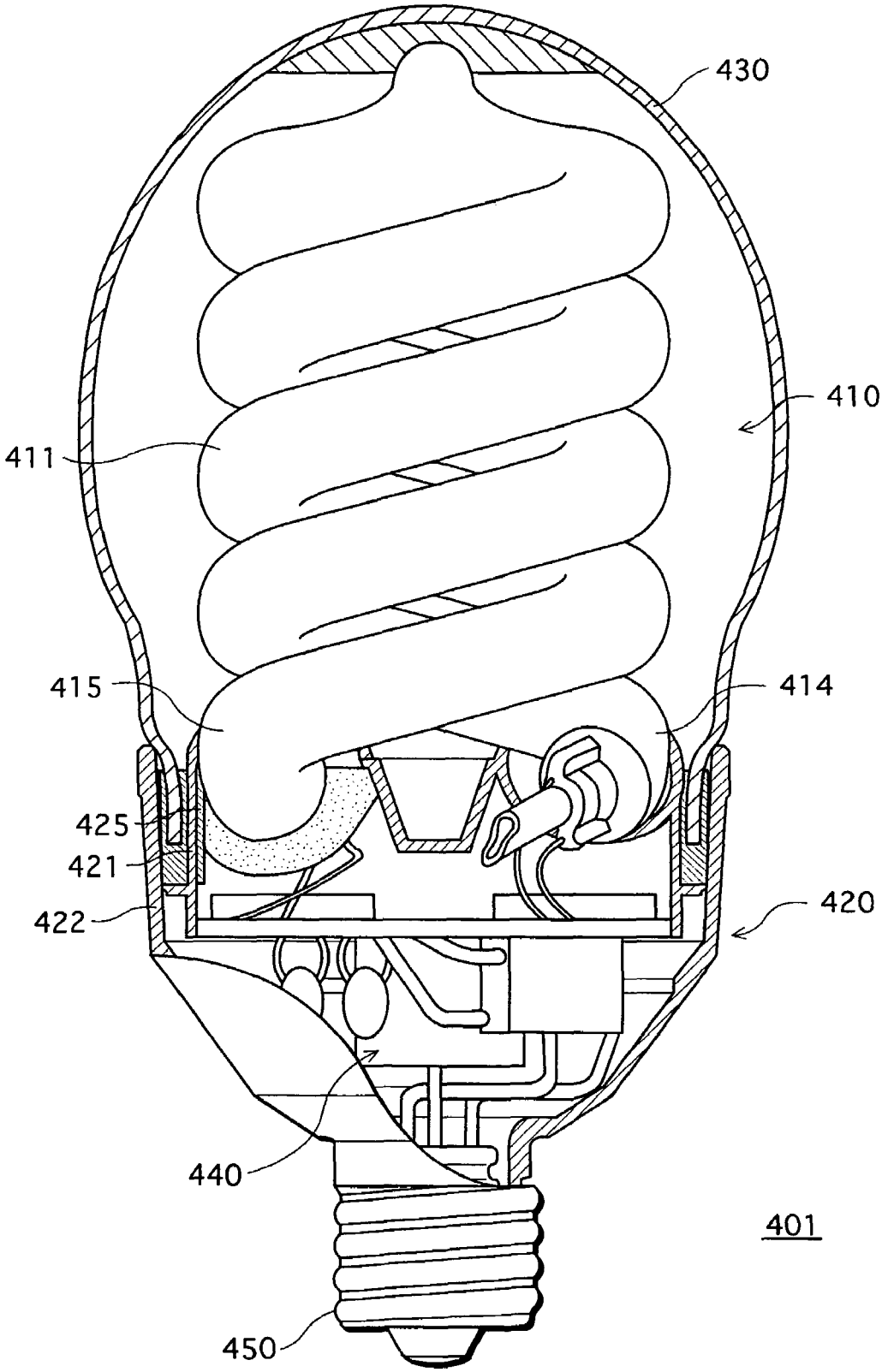
FIG. 8 is a diagram showing one example of applying the present invention to a compact self-ballasted fluorescent lamp equipped with a globe.

In the above-described embodiment, the explanation is based on the premise that the compact self-ballasted fluorescent lamp is used with no globe (i.e. an outer bulb) for covering the arc tube. However, needless to say, the present invention is also applicable to the compact self-ballasted fluorescent lamp equipped with a globe. As follows, such a compact self-ballasted fluorescent lamp equipped with a globe is explained with use of FIG. 8.

As shown in this drawing, a compact self-ballasted fluorescent lamp 401 is provided with an arc tube 410 in a double-spiral configuration, and a holder 420 to hold the arc tube 410. In addition, a globe 430 for covering the arc tube 410 is provided for this compact self-ballasted fluorescent lamp 401.

The holder 420 stores therein an electronic ballast 440 for lighting the arc tube 410. In addition, to one end the holder 420 which is on the opposite side to the side by which the arc tube 410 is to be held, a base 450 is attached. The holder 420 is constituted by the holding resin member 421 and a resin cover 422, just as in the embodiment.

Inside the holding resin member 421, a metal plate 425 is provided at an area that includes where the filament coils are provided within the ends of the glass tube 411 constituting the arc tube 410, just as in the embodiment. Note that the material and the size of the metal plate 425, or the position and the range in which the metal plate 425 is to be placed, are determined according to the position at which the filament coils are to position inside the holding resin member.

The globe 430 is, just as the incandescent lamp, is made of glass material having excellent decorative characteristics, and is shaped like an eggplant (so called A-type). Note here that the shape of the globe 430 is A-type, but is not limited to such.

The rim of the opening of the globe 430 is inserted and attached between the circumferential wall of the holding resin member 421 and the resin cover 422 that is fit to and covers the outer surface of the holding resin member 421. The attaching of the globe 430 is performed with use of an adhesive filled between the holding resin member 421 and the resin cover 422. Note that in the aforementioned embodiment, the heat-insulation layer 255 is formed between the holding resin member 210 and the resin cover 250. However in this modification example, the globe 430 functions as the heat-insulation layer 255 of the embodiment.

In addition, it is preferable that the adhesive used for attaching the globe 430 has excellent heat-resistance. This is for transmitting heat generated around filament coils, from the holding resin member 421 to the globe 430, in a case when the filament coils generate extraordinary heat at the end of life of the compact self-ballasted fluorescent lamp 401. Note that the size of a gap between the outer surface of the holding resin member 421 and the inner surface of the resin cover 422, in this compact self-ballasted fluorescent lamp 401, is set as 2.1 mm.

Next, the result of the life test conducted for the above-described compact self-ballasted fluorescent lamp 401 equipped with a globe is explained. The test has been conducted both in downward illumination and in lateral illumination. As a result, no deformation due to heat was observed in the holder 420.

The reason for this result is considered as follows. The heat in the glass tube 411 at the end-vicinity parts 414 and 415 is transmitted to the metal plate 425. The metal plate 425 disperses this heat for dissipation, thereby transmitting the dispersed heat to the holding resin member 421. Therefore, not so much heat will be transmitted to the holding resin member 421, and so, naturally, there is reduced amount of heat transmitted to the globe 430 from the holding resin member 421. Note that the heat transmitted to the globe 430 is dispersed in the entire globe 430 then is dissipated.

2. Heat-Dissipating Plate (a) Provision of Metal Plate

In the embodiment, the metal plate and the holding resin member are produced separately, and after this, the metal plate is provided inside the holding resin member. However, it is also possible to produce the metal plate and the holding resin member together, at the same time. For such a production, so called insert molding method may be used, in which the metal plate is pre-set in a mold before the holding resin member is produced in the mold, for example.

(b) Structure of Heat-Dissipating Member

In the present embodiment, the two heat-dissipating members are connected by a connecting member ("connecting part" in the embodiment) into one piece, and this piece is made of one metal plate. Alternatively, however, the heat-dissipating members may be two different bodies, without being connected to each other. In this case, the number of heat-dissipating members in the invention is two.

In the embodiment, a metal plate of the embodiment has a structure in which the side-surface parts and the rear-surface parts are formed as one piece. However, the side-surface parts may be a separate body from the rear-surface parts, for example. In such a case, the number of heat-dissipating members in the present invention is three (i.e. a member formed by the connecting part 245 connecting the rear-surface parts 241 and 242 of the present embodiment, and two members that are two side-surface parts 243 and 244). So as to provide such three separate heat-dissipating members in the holding resin member, one method is to first provide the heat-dissipating member made up of rear-surface parts, for the end wall of the holding resin member, then to insert the ends of the glass tube. While this state being kept, each of the heat-dissipating members respectively made of one side-surface part can be placed at a corresponding inner surface of the circumferential wall of the holding resin member. After this, all the three heat-dissipating members can be attached to the glass tube by means of a silicone resin. Alternatively, furthermore, all the rear-surface parts and the side-surface parts, of the embodiment, may be four separate bodies, thereby endowing the invention with four heat-dissipating members in total.

Furthermore, in the embodiment, the metal plate is provided to be abutted against the inner surface of the holder. However, it is not always necessary to make the metal plate abut against the inner surface of the holder. Which is to say, if the heat-dissipating plate is provided at a position between the inner surface of the holder and outer surface of the glass tube where it corresponds to the position of the filament coils, then the heat from the filament coils will be transmitted to the heat-dissipating plate, thereby reducing the amount of heat to be transmitted to the holder.

With this in view, a metal plate may alternatively be shaped as a tube, so as to elongate along the outer surface of the glass tube and to cover the end-vicinity parts of the glass tube, for example. Note that the tube-shaped metal plate may be fixed, at the same time when the end-vicinity parts of the glass tube are fixed within the holder by means of a silicone resin.

3. Holder

The holder, described in the aforementioned embodiment, is constituted by: a holding resin member with a cylindrical shape having a closed bottom; and a resin cover, and has a structure in which the rein cover is fit to the circumferential wall of the holding resin member. However, the holder is not limited to such a structure, and may be structured such as in the following examples.

One example has a structure in which the holding resin member is shaped like a disk, and the rim of the holding resin member is fixed to the inner surface of the resin cover. In this case too, the same method can be taken as described in the embodiment. That is, the metal plate is provided for the holding resin member, and the ends of the glass tube are inserted from the respective insertion openings. Then, while the described states are kept, the holding resin member, the metal plate, and the ends of the glass tube are fixed by means of a silicone resin, and then a resin cover is assembled therewith.

In another example, the holder is constituted by: a holding resin member with a cylindrical shape having a closed bottom; and a resin cover, just as in the embodiment. However, the structure is such as to fit the outer surface of the resin cover to the inner surface of the circumferential wall of the holding resin member. If this structure is adopted, it is necessary to provide the side-surface parts of the heat-dissipating plate inside the resin cover.

4. Heat-Insulation Layer

In the embodiment, the heat-insulation layer is an air layer realized by using the gap created between the holding resin member and the resin cover. However, for example, it is also possible to place a metal plate between the holding resin member and the resin cover, to produce the same effect as the embodiment. Note that the heat-insulation layer using the metal plate can insulate heat from the holding resin member more efficiently, compared to the heat-insulation layer using the air, and so can prevent the resin cover from deformed due to heat, to a greater extent.

In addition, if a metal plate is used as the heat-insulation layer, the thickness thereof is preferably in a range of 0.4 mm to 0.9 mm, inclusive. This is because if the thickness of the metal plate is thinner than 0.4 mm, enough heat-insulation effect is not obtained. Conversely, if the thickness thereof becomes thicker than 0.9 mm, although this case will achieve high heat-insulation characteristic, the diameter of the resin cover becomes too large, or that the rigidity of the metal plate becomes high, thereby sacrificing the workability of providing the metal plate, or the cost of the metal plate.

5. Fluorescent Lamp

Figure 9:
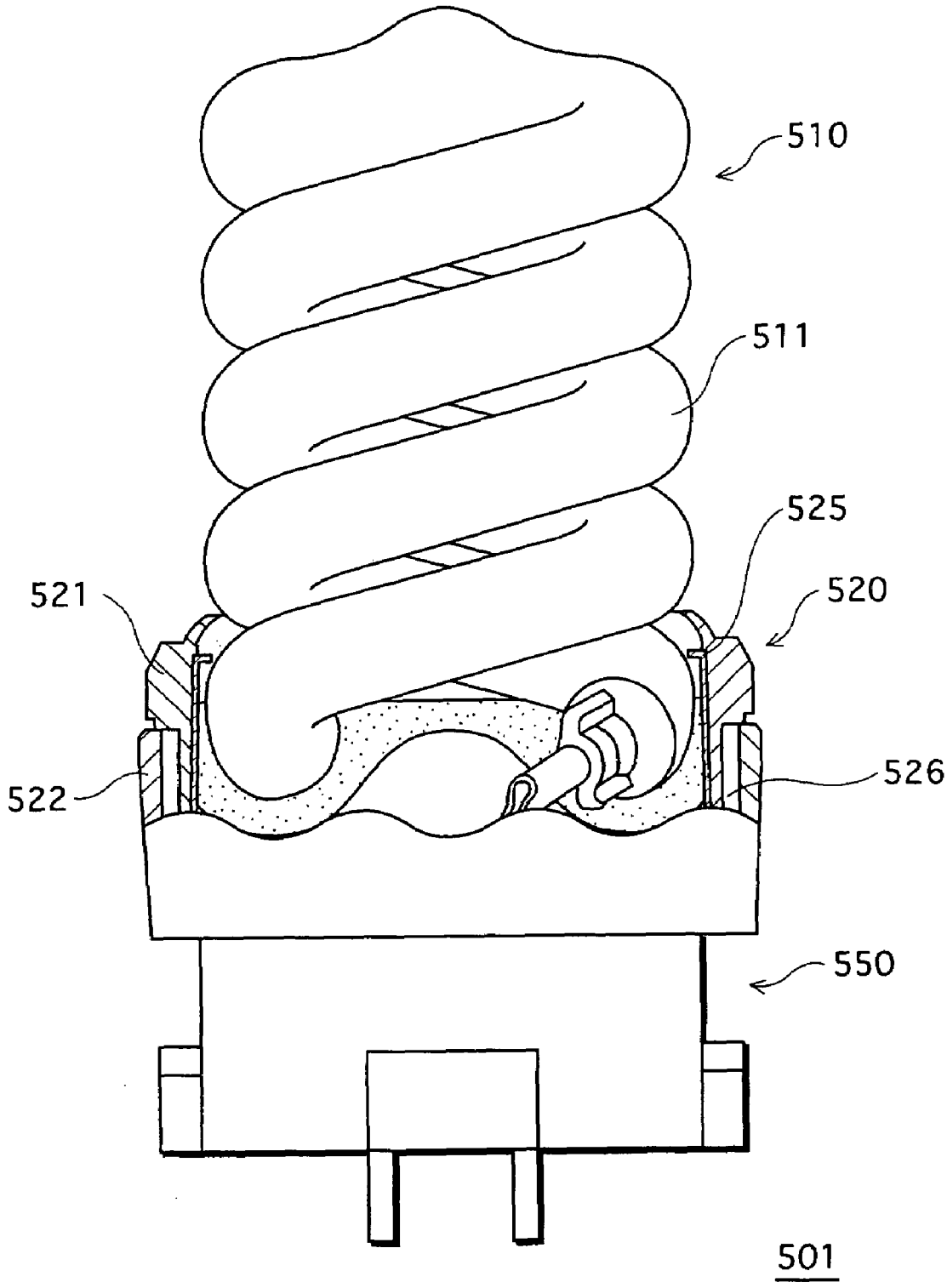
FIG. 9 is a diagram showing one example of applying the present invention to a fluorescent lamp.

The aforementioned embodiment describes a case when the present invention is applied to a compact self-ballasted fluorescent lamp. However, the present invention is also applicable to a fluorescent lamp as FIG. 9 shows, for example.

This fluorescent lamp 501 includes: an arc tube 510 whose glass tube 510 is spirally wound from the turning part to the both ends to have a double-spiral configuration; a holder 520 that holds this arc tube 510 (both end-vicinity parts of the glass tube 511); and a single base 550 (e.g. GX10q-type) that can receive electricity by being fit to a socket which is an illuminating device. This fluorescent lamp 501 is different from the aforementioned compact self-ballasted fluorescent lamp 100, in that the holder 520 does not store therein an electronic ballast, and that the base 550 is shaped differently from a screw type used for the incandescent lamp.

The holder 520 has the same structure as that of the aforementioned embodiment, and is constituted by a holding resin member 521 and a resin cover 522. Inside the holding resin member 521, a metal plate 525 is provided at a position corresponding to where the filament coils are placed in the glass tube 511. Note that the material and the size of the metal plate 525, or the position and the range in which the metal plate 525 is to be placed, are determined so as to take into allowance the range of positional variation of the filament coils in the glass tube 511, the positional variation being incident to fixing of the arc tube 510 to the holder 520.

In addition, between the holding resin member 521 and the resin cover 522, a heat-insulation layer 526 is formed, just as in the embodiment. This heat-insulation layer 526 is provided at a position corresponding to where the filament coils are, within the arc tube 510 that has been incorporated in the holder 520.

As already described in the related art section, in the life test directed to the fluorescent lamp 501, too, the electron emissive material filled in the filament coils is used up, thereby causing the filament coils to generate extraordinary heat.

As such, even if the filament coils generate extraordinary heat, the holder 520 will be prevented from being deformed due to heat, because of the structure of having the metal plate 525 on the inner surface of the holding resin member 521 that constitutes the holder 520, and of having the heat-insulation layer 526 between the holding resin member 521 and the resin cover 522. Note that the discharge lamp described here is just one example to which the present invention is applied. Needless to say, the present invention is not limited to what is described in FIG. 9, as far as the number of turns for the spiral parts, the outer diameter of the glass tube, the annular outer diameter and the length of the arc tube, and the form of the single base.

That is, the fluorescent lamp of the present example is characterized by having: an arc tube made of a glass tube whose at least one part is bent, ends of the glass tube being respectively provided with an electrode equipped with a filament coil, the filament coil being applied with an electron emissive material; and a holder that is provided with insertion openings and holds the ends of glass tube in a state that the ends are inserted through the respective insertion openings, where the ends of the glass tube are inserted until the filament coils reach inside the holder, and a metal plate is provided between the inner surface of the holder and the parts of the glass tube that correspond to where the filament coils are positioned in the glass tube.

6. Form of Arc Tube

Both of the embodiment and the modification examples use an arc tube in a double-spiral configuration. However, an arc tube having other forms may alternatively be used. For example, it is also possible to use an arc tube in single-spiral configuration having only one spiral part, where its glass tube is bent at the substantial middle to form a turning part, and is wound from the turning part to one end. In this case, the heat-dissipating plate may be provided around the end at the spiral part side.

Furthermore, it is also possible to constitute an arc tube by a combination of three or four glass tubes respectively in U-shape. Even if the arc tube is constituted by a combination of three or four glass tubes as above, only one discharge space will be formed in the combined glass tubes on the whole. Therefore the whole of the combined glass tubes is referred to as "one glass tube", and electrodes will be sealed in the ends of this glass tube. Note that in a case where the filament coils of the glass tube are positioned outside the holder, the problem of the present invention cannot arise. However, the present invention is still applicable to such a glass tube, in a case where, for some reason, the filament coils of the glass tube are positioned inside the holding resin member.

Although the present invention has been fully described byway of examples with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A compact self-ballasted fluorescent lamp comprising:

an arc tube made of a glass tube that has a turning part, and of electrodes sealed in ends of the glass tube, the electrodes being each equipped with a respective one of filament coils;

a holder that is provided with insertion openings and holds the arc tube so that the ends of the glass tube are inserted through the respective insertion openings and that the filament coils are positioned inside the holder; and heat-dissipating members provided for two places that are respectively between an outer surface of the glass tube and an inner surface of the holder, each of the places corresponding to a different one of the filament coils.

2. The compact self-ballasted fluorescent lamp of claim 1, wherein the glass tube has two spiral parts wound around a predetermined axis from the turning part to the ends of the glass tube, to form a double-spiral configuration.

3. The compact self-ballasted fluorescent lamp of claim 1, wherein the heat-dissipating members are provided along an orbit in which the ends of the glass tube are inserted.

4. The compact self-ballasted fluorescent lamp of claim 1, wherein the heat-dissipating members are provided to make allowance for positional variation of the filament coils, the positional variation being incident to fixing of the arc tube to the holder.

5. The compact self-ballasted fluorescent lamp of claim 1, wherein the holder includes: a holding member with a cylindrical shape having an end wall, the end wall being provided with the insertion openings; and a resin cover fit to an outer surface of a circumferential wall of the holding member, and the heat-dissipating members are provided on inner surfaces of the end wall and of the circumferential wall, in the holding member.

6. The compact self-ballasted fluorescent lamp of claim 1, wherein each of the places is provided with one heat-dissipating member, and a connecting member connects the two heat-dissipating members.

7. The compact self-ballasted fluorescent lamp of claim 6, wherein the two heat-dissipating members are integrated with the connecting member into one piece, and the piece is made of a thin metal plate.

8. The compact self-ballasted fluorescent lamp of claim 5, further comprising:

a heat-insulation layer provided between the circumferential wall of the holding member and the resin cover, and at position corresponding to where the filament coils are.

9. The compact self-ballasted fluorescent lamp of claim 8, wherein the heat-insulation layer is a gap formed between the circumferential wall and the resin cover, the gap having a width of in a range of 0.5 mm to 1.0 mm inclusive and being filled with air.

10. The compact self-ballasted fluorescent lamp of claim 8, wherein the heat-insulation layer is a metal plate whose thickness is in a range of 0.4 mm to 0.9 mm inclusive.

11. The compact self-ballasted fluorescent lamp of claim 8, wherein the heat-insulation layer is provided to make allowance for positional variation of the filament coils, the positional variation being incident to fixing of the arc tube to the holder.

* * * * *